United States Patent [19]

Wu

[11] 4,111,192

[45] Sep. 5, 1978

[54] BIOLOGICAL TISSUE EXERCISING DEVICE

[76] Inventor: An-Chuan Wu, No. 217, Chien Kuo S. Rd., Taipei, Taiwan

[21] Appl. No.: 765,891

[22] Filed: Feb. 7, 1977

Related U.S. Application Data

[63] Continuation-in-part of Ser. No. 588,168, Jun. 18, 1975, Pat. No. 4,029,088.

[51] Int. Cl.[2] ..... A61H 1/00

[52] U.S. Cl. ..... 128/38

[58] Field of Search ..... 128/38–40, 128/67, 281, 282, 25 R

[56] References Cited

U.S. PATENT DOCUMENTS

| | | | |
|---|---|---|---|
| 67,663 | 8/1867 | Mattson | 128/38 |
| 72,604 | 12/1867 | Cole | 128/281 |
| 1,312,619 | 8/1919 | D'Orsay | 128/40 |
| 1,599,628 | 9/1926 | Ahlgren | 128/38 X |
| 2,211,214 | 8/1940 | Miller | 128/38 |
| 2,249,500 | 7/1941 | Shirley et al. | 128/38 UX |
| 2,616,417 | 11/1952 | Holbrook | 128/38 |
| 2,668,315 | 2/1954 | Crosby | 128/38 X |
| 3,382,867 | 5/1968 | Reaves | 128/38 |
| 4,033,338 | 7/1977 | Igwebike | 128/38 |

FOREIGN PATENT DOCUMENTS

| | | | |
|---|---|---|---|
| 686,367 | 1/1953 | United Kingdom | 128/281 |
| 16,448 of | 1910 | United Kingdom | 128/281 |

*Primary Examiner*—Lawrence W. Trapp
*Attorney, Agent, or Firm*—Michael J. Striker

[57] ABSTRACT

A biological tissue exercising device comprises a shape-retaining cup adapted to be placed over human breast tissue with clearance so as to define an interior space therewith. The device includes an air-evacuation arrangement which may be a compressible pumping element, or an air blower which comprises a housing having an inlet in communication with air in the interior space, and an outlet in communication with air at the exterior of the cup. The air blower having a plurality of blades is mounted in the housing and is electrically connected to a motor also mounted in the housing. A switch activates the motor for rotating the blades to thereby exhaust air from the interior space through the inlet to be expelled via the outlet to the cup exterior, and also deactivates the motor for preventing further rotation of the blades to thereby admit air from the cup exterior through the outlet to be admitted via the inlet to the interior space. Successive activation and de-activation of the blower thus causes the breast to be moved in opposite directions so as to strengthen the breast tissue.

9 Claims, 5 Drawing Figures

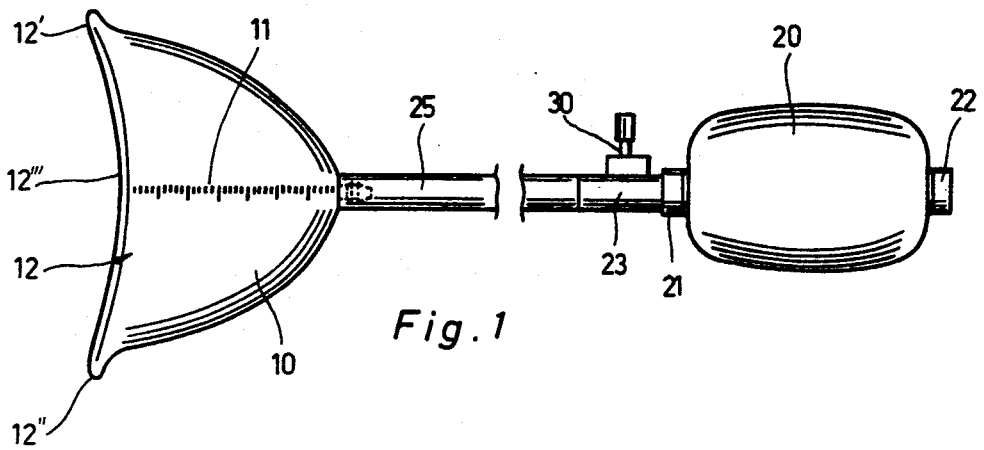
Fig. 1
Fig. 2
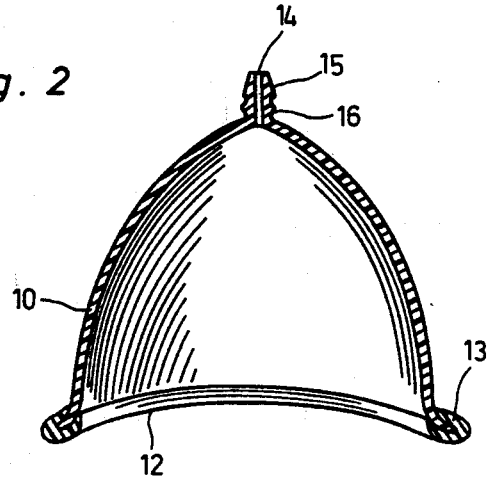
Fig. 3
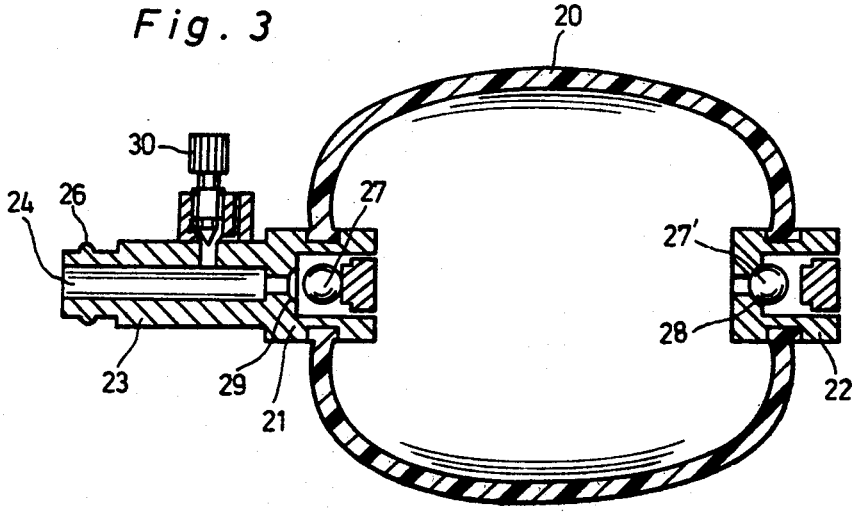

BIOLOGICAL TISSUE EXERCISING DEVICE

CROSS-REFERENCE TO RELATED APPLICATION

The present application is a continuation-in-part application of my prior application, Ser. No. 588,168, filed June 18, 1975, now U.S. Pat. No. 4,029,088.

BACKGROUND OF THE INVENTION

The present invention relates to a biological tissue exercising device, and more particularly to a biological device for strengthening human breast tissue.

The strengthening or building up of biological tissue in the female human breast is a well-known problem in physiotherapy. One medical approach uses surgical techniques such as breast implant operations, while non-surgical techniques include the use of external creams or internal hormone preparations. The surgical technique is a relatively expensive medical operation and requires an extended hospital stay; the nonsurgical techniques have been found to be either totally ineffective or to cause harmful side effects.

Another medical approach has included hydrotherapy, wherein jets of pulsating water are directed to impinge upon the breast tissue. This approach has the disadvantage that the breast tissue is rather delicate and is easily damaged by such pulsating jets.

It has been proposed to use a cup connected to a source of suction. This cup however has an open side surrounded by a lip which lies in a plane so that it has the disadvantage that it is not particularly well adapted to fit and/or be sealed with respect to the breast tissue.

Moreover, this cup is provided with an eccentrically disposed nozzle which connects to the suction source. Thus, this cup has the drawback of providing non-uniform movement of different portions of the breast tissue depending upon the position of respective portions of the tissue relative to the nozzle.

Still furthermore, this cup is not provided with any electrically-operable means for exhausting air from the interior of the cup so as to draw the breast further therein, nor for venting the vacuum in the cup when desired. Such vacuum release is generally obtained only by gradual air leakage.

SUMMARY OF THE INVENTION

Accordingly, it is the general object of the present invention to overcome the disadvantages of the prior art.

More particularly, it is an object of the present invention to strengthen breast tissue so as to achieve a higher, fuller and firmer bustline without causing any physical harm to a user.

A further object of the present invention is to provide an exercising and strengthening device which is both safe to use and effective in operation.

Another object of the present invention is to provide an exercising and strengthening device which is well adapted to be fitted and sealed to the breast tissue.

Yet another object is to provide an exercising and strengthening device which is efficient and reliable in both air-removal and air-admission functions.

In keeping with these objects and others which will become apparent hereinafter, one feature is the placement of a shape-retaining cup over a human breast with clearance so as to define an interior space therewith. Means for evacuating air from this interior space is connected with the shape-retaining cup so as to draw the breast further within the cup, and thereby to exercise the breast tissue. The shape-retaining feature of the cup assures that the biological tissue will be firmly and adequately drawn into the interior space.

Another feature is to make the shape-retaining cup of transparent material and to provide it with indicating means, such as gradations. Thus, the relative distance through which the breast is drawn into the interior space can be noted by the user. This data is useful for charting the progress and growth of the biological tissue, as well as for serving as a guide for its safe operation so that the pressure developed by the air-evacuation means will not cause excessive physical stress on the tissue.

Still another feature is to provide the cup with a concave marginal wall or lip which surrounds the open side of the cup which receives the breast. The lip has top, bottom and side portions which respectively engage top, bottom and side regions of the breast. In accordance with the invention, the side portions curve along their entire length intermediate the top and bottom portions in direction further into the cup so as to securely and tightly engage the respective breast regions.

Another feature of the invention is to provide the air-evacuation means and the shape-retaining cup with an outlet or nozzle having friction-retention means for retaining a flexible conduit thereto. The conduit is connected intermediate the shape-retaining cup and the air-evacuation means. The friction-retaining means assures that the ends of the flexible conduit will not become disengaged during the buildup and release of pressure by the air evacuating means. The nozzle is advantageously located in a central region of the cup so as to uniformly move the breast tissue.

Another feature of the invention is to provide cooperating valve means on a resilient pumping element. By squeezing opposite wall portions of the pumping element towards each other, a pressure condition will be created which either urges obstruction members mounted in air flow passages provided in the resilient element inwardly or outwardly of each other. This feature assures that a user may regulate and control the amount of air being evacuated, as desired.

A further feature is to provide means for adjustably admitting ambient air into the interior space and for releasing the vacuum condition therein. This feature assures that the breast will return to its original position within the cup due to its own inherent muscle tenacity.

In accordance with yet another feature of the invention, air is continuously evacuated from the interior space of the cup by pressing a button or electrical switch which is connected to a motor-operated blower arrangement. Release of the switch results in immediately allowing ambient atmosphere at the exterior of the cup to be admitted into the interior space.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a diagrammatic side view of an apparatus according to one embodiment of the present invention;

FIG. 2 is a sectional view of the shape-retaining cup;

FIG. 3 is a sectional enlarged view showing a detail of the embodiment of FIG. 1 during one portion of the operational cycle;

DESCRIPTION OF THE PREFERRED EMBODIMENTS

Figure 4:
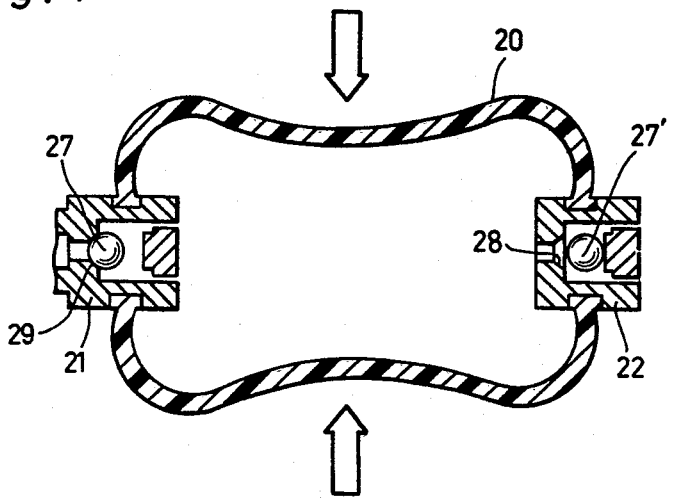
FIG. 4 is a sectional enlarged view showing a detail of the embodiment of FIG. 1 during another portion of the operational cycle.

Discussing the apparatus which has been illustrated in an exemplary embodiment in FIGS. 1 through 4, it will be seen that the reference numeral 10 identifies a shape-retaining cup adapted to be placed over biological breast tissue with clearance. The cup 10 is formed of any suitable shape-retaining material which is preferably transparent, for example, clear synthetic plastic material, glass or any glass-like thermoplastic resin material. Indicating means 11 is provided on the transparent cup 10 for indicating the distance through which the breast is drawn into the cup, as will be described herein.

The shape-retaining cup 10 further comprises a lip portion or marginal wall 12 which encircles an open side of the cup 10 which receives the breast. The lip 12 has a concave configuration as shown in FIG. 1, i.e. the lip 12 is formed with an arc bottom circle for the purpose of fitting the cup to the breast tissue.

In other words, the concave lip 12 has top 12', bottom 12'', and side 12''' portions which resepctively engage top, bottom and side regions of the breast to be strengthened. The side portions 12''' curve along their entire length intermediate the top 12' and bottom 12'' portions in direction further into the cup 10 so as to properly encircle and engage the respective regions of the breast tissue.

The lip 12 may be covered with a resilient sealing material 13, such as flexible rubber, for promoting a user's feeling of comfort when in contact with the skin, and for sealing the interior space from the ambient atmosphere.

Means for evacuating air from the interior space, which is formed intermediate the breast tissue and the inner circumferential surface of the cup 10, comprises, in a first embodiment, a resilient pumping element 20 which has opposite wall portions which define an interior region. Inlet valve 21 and outlet valve 22 are provided on the resilient pumping element 20.

The cup 10 is provided with an outlet or nozzle 14 disposed at the topmost center thereof. The nozzle 14 has a passage which is in constant communication with the aforementioned interior space defined by the cup 10. The inlet valve 21 also has an air-inlet nipple housing 23 which accommodates a passage 24 which communicates with the above-mentioned interior region of the pumping element 20 depending upon the operation of the inlet valve 21.

The tubular element or conduit 25 is hollow and has one of its ends connected to the outlet 14 and the other of its ends connected to the nipple 23. Friction-retention means 15, 16 and 26 are respectively provided on the outlet 14 and the nipple 23 for frictionally retaining the ends of the tubular conduit 25. The tubular conduit 25 is preferably made of flexible material, such as rubber and/or plastic hosing, and is mounted in place by pushing its ends over the respective friction-retention means. Friction-retention means 15 is tapered to ease and facilitate the mounting of the conduit 25; and friction-retaining means 16 and 26 project outwardly so as to firmly engage the conduit 25 and prevent it from disengaging during the operation of the air-evacuating means.

Inlet valve 21 and outlet valve 22 are respectively provided with air flow passages and obstruction members or balls 27, 27' which are movably mounted so as to admit or prevent air from flowing in the air flow passages. The obstruction members 27, 27' are normally urged by biasing means, such as a spring or the like (not illustrated for purpose of clarity), into a first position in which the respective obstruction members 27, 27' are urged inwardly towards each other, as shown in FIG. 3. Obstruction member 27' is urged to seat in its valve seat 28; whereas, obstruction member 27 is urged off of its valve seat 29. In this first position, the air in the interior space defined by the cup 10 is in direct communication with the interior region defined by the pumping element 20 since the obstruction member 27 does not block the passage 24. Moreover, in the first position, the air within the pumping element 20 cannot escape to the ambient atmosphere, because the obstruction member 27' prevents such passage.

By displacing the wall portions of the resilient pumping element 20 towards each other, in the direction of the arrows as illustrated in FIG. 4, a pressure differential will develop and the obstruction members 27, 27' will be urged outwardly away from each other. In this second air-evacuation position, obstruction member 27 is urged into its valve seat 29; and obstruction member 27' is urged off of its valve seat 28.

In this second position, the air within the pumping element 20 is in direct communication with the ambient atmosphere since the obstruction member 27' no longer blocks such passage. Moreover, in this second position, the air within the pumping element 20 cannot escape or be ejected back towards the cup 10, since the obstruction member 27 effectively blocks the passage 24 and prevents such passage.

An air-admitting arrangement is mounted on nipple housing 23 which is connected to conduit 25 intermediate the interior region defined by the cup 10 and the interior space defined by the pumping element 20. This air-admitting arrangement comprises an adjustable element, such as a screw 30, which is movably mounted in a bypass passage leading to the primary passage 24. Upon turning the adjustable element 30 in requisite direction, air from the ambient atmosphere is admitted into the primary passage 24. This action releases the vacuum condition created within the cup 10.

The adjusting element 30 preferably has a tapered cross section at its leading end so that the amount of air entering from the ambient atmosphere can be regulated.

Upon turning the adjusting element 30 in the opposite direction, such air flow from the ambient atmosphere is prevented.

It is believed that the operation of the breast tissue strengthening device is already clear from the above description. By repeatedly displacing the wall portions of the resilient pumping element 20, an increasing vacuum condition is created between the breast tissue and the cup 10. I have found that maintaining the vacuum condition at a level sufficient for the breast to be drawn by about 2 cm into the cup is satisfactory for most applications. By alternately repeating the operations of the adjusting element 30 of the air-inlet nipple 23 with the air-evacuation means, the breast tissue will be exercised. The breast will be drawn into the cup 10 during the operation of the air-evacuating means; and the breast will return to its original position due to its own muscular tension during the operation of the adjusting element 30.

I have found it to be particularly advantageous if the above-mentioned cycle is repeated for 15 minutes, twice a day, preferably once in the morning and once in the evening.

Figure 5:
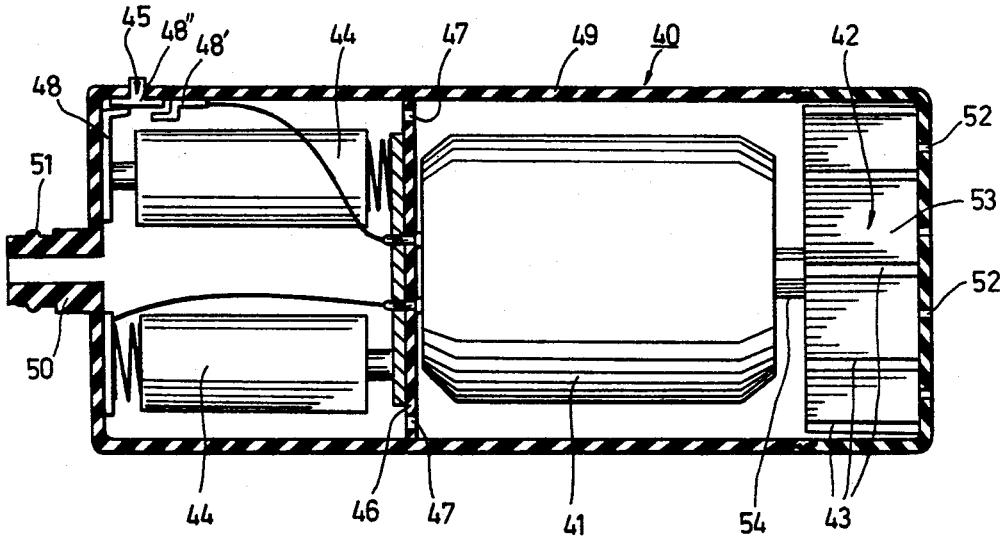
FIG. 5 is a sectional enlarged view of an apparatus according to another embodiment of the present invention.

The embodiment of FIG. 5 illustrates another air-evacuation device which may be used instead of the resilient pumping element 20. The device 40 comprises a cylindrical, electrically-insulating housing 49 having an air inlet 50 provided with friction-retention means 51 for connection to the conduit 25 in analogous manner to the description given above for housing 23 and friction-retention means 26. Alternatively, the inlet 50 may be directly connected to the nozzle 14 of the cup 10. The housing 49 also comprises an air outlet or holes 52 for establishing communication with the air at the exterior of the cup.

Electrically-operated means is mounted in the cup for respectively evacuating and admitting air relative to the interior of the cup so as to move the breast in opposite directions. The means includes a small-sized electric motor 41 fixedly mounted on partition wall 46. The motor or drive 41 is connected via shaft 54 to a fan or blower 42 having a plurality of radially-extending rotary blades 43 mounted in circumferential direction about shaft 54.

A source of electrical energy or a pair of series-connected batteries 44 is connected to the motor 41 for energizing the same by operation of the switching means or push button switch 45. The switch 45 has a pair of electrically-conductive stationary parts 48, 48' which are electrically connected to each other by user actuation of an armature part 48".

In operation, when a user depresses armature part 48", electrical contact is made between the batteries 44 and the motor 41 so long as the part 48" is depressed. The motor 41 is thus actuated and is operative for rotating the blades 43 so as to generate a suction force which exhausts air from the interior space through the inlet 50 and also through the holes 47 formed in partition 46. This exhausted air subsequently passes through air channels 53 formed intermediate the blades 43 and is expelled through outlets 52 to the ambient atmosphere. After the breast has been drawn from an initial position in direction further into the cup for a sufficient distance as monitored by the gradations 11, the armature 48" is released and the motor de-energized. In this case, the blower 42 stops, and ambient atmosphere flows from the exterior of the cup successively through the holes 52, the air channels 53, the holes 47, th inlet 50, and the interior space of the cup 10. This admission of air releases the previously generated vacuum condition so as to permit the breast to return towards its initial position. Successive activation and deactivation of the switch 45 will result in movement of the breast in opposite directions, thereby tending to exercise and strengthen the breast tissue.

Other constructions of the embodiment of FIG. 5 are also possible without departing from the spirit of the invention. The switch 45 need not be of the "hold-down" type but may be of other types, such as a toggle switch.

It is well known that the pituitary gland governs the secretion of the endocrine glands and regulates the amount of hormones, such as estrogen and progesterone, in the blood stream. These hormones, amongst other factors, induce the growth of breast tissue. Since the breast has many estrogen-progesterone secreting glands, it is closely linked with the pituitary gland. By reflex exciting the breast tissue, the pituitary gland will be, in turn, stimulated. The pituitary will now secrete more hormones, thus strengthening and forming the breast tissue.

It will be understood that each of the elements described above, or two or more together, may also find a useful application in other types of biological tissue strengthening devices differing from the types described above.

While the invention has been illustrated and described as embodied in a biological tissue strengthening device, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for exercising biological tissue, particularly tissue of the female human breast, comprising a shape-retaining cup constituted by transparent material and adapted to be placed over a human breast with clearance so as to define an interior space therewith, said cup comprising indicating means thereon for indicating the distance through which the breast has been drawn; a housing having an inlet in communication with air in said interior space, and an outlet in communication with air at the exterior of said cup; and electrically-operated means in said housing for exhausting air from said interior space through said inlet to be expelled via said outlet to the exterior of said cup so as to draw the breast from an intial position in direction further into said cup, said electrically-operated means also being operative for admitting air from the exterior of said cup through said outlet to be admitted via said inlet into said interior space so as to permit the breast to return towards the initial position.

2. A device as defined in claim 1, wherein said cup has an open side for receiving the breast, and a concave marginal wall having top, bottom and side portions together surrounding said open side and respectively engaging top, bottom and side regions of the breast, said side portions curving along their entire length intermediate said top and bottom portions in direction further into said cup and away from said open side.

3. A device as defined in claim 2, and further comprising means at said concave marginal wall for sealing air contained in the interior space of said cup from air located at the exterior of said cup.

4. A device as defined in claim 1, wherein said cup has a nozzle in communication with air in said interior space; and further comprising a conduit having one end connected with said nozzle, and another end connected with said inlet of said housing.

5. The device as defined in claim 1, wherein said electrically-operated means comprises an exhaust blower having a plurality of rotary blades which bound air channels, each channel having one end in communication with said inlet and another end in communication with said outlet; and wherein said electrically-operated means further comprises drive means for rotating said blades so as to generate a suction force which evacuates air from said interior space through said channels to be expelled to the exterior of said cup.

6. A device as defined in claim 5; and further comprising switching means for respectively activating and de-activating said drive means so as to respectively evacuate air from and admit air into said interior space, said switching means including a movable switching element mounted for movement between an operative position in which said blower is connected to a source of electrical energy to thereby rotate said blades, and an inoperative position in which said blower is disconnected from the electrical energy source to thereby stop further rotation of said blades.

7. A device as defined in claim 5; and further comprising a partition subdividing the interior of said housing into two chambers; and wherein said drive means constitutes a motor fixedly mounted on said partition in one of said chambers.

8. A device as defined in claim 7, wherein said outlet comprises a plurality of holes formed in said housing; and wherein said inlet comprises a plurality of holes formed in said partition and in said housing.

9. A device for exercising biological tissues, particularly tissue of the female human breast, comprising a shape-retaining cup of a transparent material and having one side adopted to be placed over a human breast with clearance so as to define an interior space therewith, and another side having a nozzle in communication with air in said interior space, said cup further comprising indicating means provided for indicating the distance through which the breast has been drawn, a flexible conduit having one end connected with said nozzle, and another end; a housing having an inlet connected to said other end of said conduit for establishing communication with air in said interior space, and an outlet in communication with air in said interior space, and an outlet in communication with air at the exterior of said cup; electrically-operated means in said housing, including an exhaust blower having a plurality of rotary blades, and drive means connected with said blower for rotating said blades; and switching means on said housing for activating said drive means so as to rotate said blades and to thereby exhaust air from said interior space through said inlet to be expelled via said outlet to the exterior of said cup, whereby the breast is drawn from an initial position in direction further into said cup, said switching means also being operative for deactivating said drive means so as to prevent further rotation of said blades and to thereby admit air from the exterior of said cup through said outlet to be admitted via said inlet to said interior space, whereby the breast is permitted to return towards its initial position.

* * * * *